US006071662A

United States Patent [19]

Carmichael et al.

[11] Patent Number: 6,071,662

[45] Date of Patent: Jun. 6, 2000

[54] IMAGING MEMBER WITH IMPROVED ANTI-CURL BACKING LAYER

[75] Inventors: Kathleen M. Carmichael, Williamson; Satish R. Parikh; Donald P. Sullivan, both of Rochester; John A. Bergfjord, Sr., Macedon, all of N.Y.

[73] Assignee: Xerox Corporation, Stamford, Conn.

[21] Appl. No.: 09/121,169

[22] Filed: Jul. 23, 1998

[51] Int. Cl.[7] ..... G03G 5/10

[52] U.S. Cl. ..... 430/69; 430/56; 428/412; 428/220

[58] Field of Search ..... 430/56, 57, 58, 430/59, 69, 533, 930; 428/412, 220; 399/159

[56] References Cited

U.S. PATENT DOCUMENTS

| | | | |
|---|---|---|---|
| Re. 33,724 | 10/1991 | Takei et al. | 430/59 |
| 3,495,984 | 2/1970 | Vanpoecke et al. | 96/87 |
| 3,725,070 | 4/1973 | Hamb et al. | 96/87 R |
| 3,793,249 | 2/1974 | Hamb et al. | 260/47 C |
| 3,856,751 | 12/1974 | Wilson | 260/33.4 |
| 4,654,284 | 3/1987 | Yu et al. | 430/59 |
| 4,865,934 | 9/1989 | Ueda et al. | 430/59 |
| 4,942,105 | 7/1990 | Yu | 430/58 |
| 4,943,508 | 7/1990 | Yu | 430/129 |
| 5,008,167 | 4/1991 | Yu | 430/56 |
| 5,021,309 | 6/1991 | Yu | 430/58 |
| 5,051,328 | 9/1991 | Andrew et al. | 430/56 |
| 5,069,993 | 12/1991 | Robinette et al. | 430/58 |
| 5,227,458 | 7/1993 | Freitag et al. | 528/196 |
| 5,298,477 | 3/1994 | Wehrmann et al. | 428/412 |
| 5,378,676 | 1/1995 | Defieuw et al. | 428/206 |
| 5,545,499 | 8/1996 | Balthis et al. | 430/59 |
| 5,554,473 | 9/1996 | Cais et al. | 430/59 |
| 5,707,767 | 1/1998 | Yu | 430/59 |
| 5,935,748 | 8/1999 | Yu et al. | 430/56 |

*Primary Examiner*—Christopher D. Rodee

[57] ABSTRACT

An electrostatographic imaging member including an anti-curl layer, a supporting substrate having an electrically conductive layer, at least one imaging layer, an optional ground strip layer and an optional overcoating layer, the anti-curl layer including a polycarbonate film forming polymer binder containing 3,3,5-trimethylcyclohexane groups in the polycarbonate moiety.

12 Claims, No Drawings

IMAGING MEMBER WITH IMPROVED ANTI-CURL BACKING LAYER

BACKGROUND OF THE INVENTION

This invention relates in general to electrostatography and, more specifically, to a flexible electrostatographic imaging member having an improved anti-curl backing layer.

In the art of xerography, a xerographic plate comprising a photoconductive insulating layer is imaged by first uniformly depositing an electrostatic charge on the imaging surface of the xerographic plate and then exposing the plate to a pattern of activating electromagnetic radiation such as light which selectively dissipates the charge in the illuminated areas of the plate while leaving behind an electrostatic latent image in the non-illuminated areas. This electrostatic latent image may then be developed to form a visible image by depositing finely divided electroscopic marking particles on the imaging surface.

A photoconductive layer for use in xerography may be a homogeneous layer of a single material such as vitreous selenium or it may be a composite layer containing a photoconductor and another material. One type of composite photoconductive layer used in electrophotography is illustrated in U.S. Pat. No. 4,265,990. A photosensitive member is described in this patent having at least two electrically operative layers. Generally, where the two electrically operative layers are positioned on an electrically conductive layer with the photoconductive layer sandwiched between a contiguous charge transport layer and the conductive layer, the outer surface of the charge transport layer is normally charged in the dark with a uniform negative electrostatic charge and the conductive layer is utilized as an electrode. The photoconductive layer is capable of photogenerating holes and injecting the photogenerated holes into the contiguous charge transport layer. The charge transport layer in this embodiment must be capable of supporting the injection of photogenerated holes from the photoconductive layer and transporting the holes through the charge transport layer. In flexible electrophotographic imaging members, the electrode is normally a thin conductive coating supported on a thermoplastic resin web. Obviously, the conductive layer may also function as an electrode when the charge transport layer is sandwiched between the conductive layer and a photoconductive layer which is capable of photogenerating electron/hole pairs and injecting the photogenerated holes into the charge transport layer when the imaging member surface is uniformly charged with a positive charge while the conductive layer beneath serves as a negative electrode to receive the injecting holes. The charge transport layer in this embodiment, again, is capable of supporting the injection of photogenerated holes from the photoconductive layer and transporting the holes through the charge transport layer.

Various combinations of materials for charge generating layers and charge transport layers have been investigated. For example, the photosensitive member described in U.S. Pat. No. 4,265,990 utilizes a charge generating layer in contiguous contact with a charge transport layer comprising a polycarbonate resin and one or more of certain aromatic amine compounds. Various generating layers comprising photoconductive layers exhibiting the capability of photogeneration of holes and injection of the holes into a charge transport layer have also been investigated. Typical photoconductive materials utilized in the generating layer include amorphous selenium, trigonal selenium, and selenium alloys such as selenium-tellurium, selenium-tellurium-arsenic, selenium-arsenic, and mixtures thereof. The charge generation layer may comprise a homogeneous photoconductive material or particulate photoconductive material dispersed in a binder. Other examples of homogeneous and binder charge generation layer are disclosed in U.S. Pat. No. 4,265,990. Additional examples of binder materials such as poly(hydroxyether) resins are taught in U.S. Pat. No. 4,439,507. The disclosures of the aforesaid U.S. Pat. No. 4,265,990 and U.S. Pat. No. 4,439,507 are incorporated herein in their entirely. Photosensitive members having at least two electrically operative layers as disclosed above in, for example, U.S. Pat. No. 4,265,990 provide excellent images when charged with a uniform negative electrostatic charge, exposed to a light image and thereafter developed with finely developed electroscopic marking particles.

When one or more photoconductive layers are applied to a flexible supporting substrate, it has been found that the resulting photoconductive member tends to curl. This is due to the difference in thermal expansion of the substrate and the photoconductive layers and the specific nature of the polymers used for each layer. Curling is undesirable because different segments of the imaging surface of the photoconductive member are located at different distances from charging devices, developer applicators and the like during the electrophotographic imaging process thereby adversely affecting the quality of the ultimate developed images. For example, non-uniform charging distances can be manifested as variations in high background deposits during development of electrostatic latent images. Coatings may be applied to the side of the supporting substrate opposite the photoconductive layer to counteract the tendency to curl. However, difficulties have been encountered with these anti-curl coatings. Anti-curl layers will also occasionally delaminate after welding into a belt or image cycling in copiers, duplicators, printers and facsimile machines. Delamination is particularly troublesome in high speed automatic copiers, duplicators and printers which require extended cycling of the photoreceptor belt. For example, delamination has occurred in as few as 8,000 cycles. Moreover, delamination is accelerated when the belts are cycled around small diameter rollers and rods.

Since the anti-curl coating is an outermost exposed layer, it has further been found that during cycling of the photoconductive imaging member in electrophotographic imaging systems, the relatively rapid wearing away of the anti-curl coating also results in the curling of the photoconductive imaging member. In some tests, the anti-curl coating was completely removed in one hundred fifty thousand to two hundred thousand cycles. This erosion problem is even more pronounced when photoconductive imaging members in the form of webs or belts are supported in part by stationary guide surfaces, e.g. backer bars) which causes the anti-curl layer to wear away very rapidly and produce debris which scatters and deposits on critical machine components such as lenses, corona charging devices and the like, thereby adversely affecting machine performance. Moreover, the debris from bisphenol A type polycarbonate anti-curl backing layers tend to deposit on backer bars and other support members. These deposits result in a loud high pitched humming sound emitted during image cycling.

It has also been observed that when conventional belt photoreceptors using a bisphenol A polycarbonate anti-curl backing layer are extensively cycled in precision electrostatographic imaging machines undesirable defect print marks are formed on copies as a result of localized cumulative deposition of anti-curl layer debris onto the backer bars which forces the photoreceptor upwardly and interferes with the toner image development process. Because the anti-curl layer wear causes debris accumulation on the backer bars to gradually increase the dynamic contact friction between these two interacting surfaces, the duty cycle of the driving motor is gradually increased to a point where the motor eventually stalls and belt cycling prematurely ceases. Further, conventional flexible photoreceptor belts carrying an anti-curl layer comprising polycarbonate A on a flexible substrate encounter delamination from bar codes on a substrate during extended image cycling. Moreover, photoreceptors using a bisphenol A polycarbonate anti-curl backing layer normally call for toxic solvents such as methylene chloride to form good coatings. Handling of toxic solvents requires the use of complex, bulky and expensive solvent recovery equipment.

INFORMATION DISCLOSURE STATEMENT

U.S. Pat. No. 5,069,993 issued to Robinette et al on Dec. 3, 1991—An exposed layer in an electrophotographic imaging member is provided with increase resistance to stress cracking and reduced coefficient of surface friction, without adverse effects on optical clarity and electrical performance. The layer contains a polymethylsiloxane copolymer and an inactive film forming resin binder. Various specific film forming resins for to the anti-curl layer and adhesion promoters are disclosed, for example in column 12, lines 57–65.

U.S. Pat. No. 5,021,309 issued to Yu on Jun. 4, 1991—In an electrophotographic imaging device, material for an exposed anti-curl layer has organic fillers dispersed therein. The fillers provide coefficient of surface contact friction reduction, increased wear resistance, and improved adhesion of the anti-curl layer, without adversely affecting the optical and mechanical properties of the imaging member.

U.S. Pat. No. 4,942,105 issued to Yu on Jul. 17, 1990—A flexible electrophotographic imaging member comprising at least one electrophotographic imaging layer, a supporting substrate layer having an electrically conductive surface and an anti-curl layer, the anti-curl layer comprising a film forming binder and from about 3 percent by weight to about 30 percent by weight, based on the total weight of said anti-curl backing layer, of a copolyester resin reaction product of terephthalic acid, isophthalic acid, ethylene glycol and 2,2-dimethyl-1-1-propane diol. This flexible electrophotographic imaging member is cycled in an electrostatographic imaging system to produce toner images.

U.S. Pat. No. 4,654,284 issued to Yu et al. on Mar. 31, 1987—An electrophotographic imaging member is disclosed comprising a flexible support substrate layer having an anti-curl layer, the anti-curl layer comprising a film forming binder, crystalline particles dispersed in the film forming binder and a reaction product of a bifunctional chemical coupling agent with both the binder and the crystalline particles. The use of Vitel PE 100 in the anti-curl layer is described, for example, in the Working Examples.

U.S. Pat. No. Reissue 33,724 issued to Takei et al. on Oct. 22, 1991—A photoreceptor is disclosed comprising a photosensitive layer and a support, wherein said photosensitive layer contains a polycarbonate compound binder selected from the group consisting of Formula A and B, wherein $R_1$ and R2 are independently hydrogen, substituted or unsubstituted aliphatic, or a substituted or unsubstituted hydrocarbon ring, provided that at least one of $R_1$ and $R_2$ has at least 3 carbon atoms. Z represents a group of atoms necessary to constitute a substituted or unsubstituted carbon ring or a substituted or unsubstituted heterocyclic ring, $R_3$ to $R_{10}$ in formulas A and B are independently hydrogen, halogen, substituted or unsubstituted aliphatic or a substituted or unsubstituted hydrocarbon ring and n is a number from 10 to 1000.A photoreceptor is disclosed comprising a photosensitive layer and a support, wherein said photosensitive layer contains a polycarbonate compound binder selected from the group consisting of two specific formulae, Formula A and Formula B.

U.S. Pat. No. 5,227,458 to Freitag et al., issued Jul. 13, 1993—Dihydroxydiphenyl cycloalkanes corresponding to a specified formula are described as well as a process for their production, their use for the production of high molecular weight polycarbonates, the polycarbonates made from dihydroxydiphenyl cycloalkane of formula (I) and films made from these polycarbonates.

U.S. Pat. No. 5,545,499 to Vernon M. Balthis, et al., issued Aug. 13, 1996—A photoconductor for use in electrophotographic reproduction devices is disclosed. This photoconductor exhibits improved oil resistance when used with liquid toners and excellent cycling stability. The photoconductors utilize a phthalocyanine dye, particularly an X-form metal-free phthalocyanine, dispersed in a medium molecular weight polyvinyl chloride binder in the charge generating layer, and charge transport molecule, particularly a hydrazone such as DEH, in a polyestercarbonate binder in the charge transport layer.

U.S. Pat. No. 4,865,934 to Hideaki Ueda, et al., issued Sep. 12, 1989—A photosensitive member is disclosed which has a charge generating layer comprising specific phthalocyanine as a charge generating material and specific resin as a binder, and/or a charge transporting layer comprising specific hydrazone compounds as a charge transporting material and dyes as an absorbent for undesired lights.

U.S. Pat. No. 5,554,473 to Rudolf E. Cais, et al., issued Sep. 10, 1996—Organic photoconductive imaging receptors are disclosed in which the charge transport layer contains as a binder, a copolycarbonate of 1,1-bis-(4-hydroxyphenyl)-3,3,5-trimethylcyclohexane and 2,2,-bis-(4-hydroxylphenyl) propane exhibit excellent wear resistance.

U.S. Pat. No. 3,856,751 issued to Wilson on Dec. 24, 1974—A polyester for use as a photographic element is formed by the condensation of a diacid with a xanthylium ion having appending oxygen substituted benzo rings. A second repeating unit can also be present which is an ester of a diacid and an aliphatic or aromatic diol. Exemplary dicarboxylic acids which can be employed include isophthalic and terephthalic acids, e.g., see column 3, lines 34 and 35. A list of exemplary alkylene gylcols including ethylene glycol, 1,2-propanediol, and 1,3-propanediol can be found at column 5, lines 17–24.

U.S. Pat. No. 3,725,070 issued to Hamb et al. on Apr. 3, 1973—A linear polyester material is disclosed which is esterified with two or more dissimilar diol units and terephthalic acid units. The linear polyesters are useful as supports for photographic elements. A summary of the potential substituent units for each polyester may be found in column 2.

U.S. Pat. No. 3,793,249 issued to Hamb et al. on Feb. 19, 1974—A linear polyester material is disclosed which is esterified with two or more dissimilar diol units and terephthalic acid units. The linear polyesters are useful as supports for photographic elements. A summary of the potential substituent units for each polyester may be found in column 2.

U.S. Pat. No. 3,495,984 issued to Vanpoecke et al. on Feb. 17, 1970—A multilayer photographic film is disclosed which includes a supporting layer comprising a mixture of cellulose triacetate and a polyester of at least one phthalic acid and at least one aliphatic diol. The use of a polyester of isophthalic acid, at least one aliphatic saturated carboxylic acid and at least one aliphatic diol can be found, for example, at column 3, lines 56–63.

Bayer Brochure "ATI 967 d,e", entitled Application Technology Information, APEC® HT for solubility Applications"—Properties and applications for Apec HT copolycarbonate resins are disclosed including use as binding agents for organic photoconductors.

CROSS REFERENCE TO COPENDING APPLICATION

This application is related to the following U.S. Patent Application:

U.S. patent application Ser. No. 09.121,168, entitled "MECHANICALLY ROBUST ANTI-CURL LAYER", filed in the name of R. Yu et al., concurrently herewith now U.S. Pat. No. 5,935,748, issued Aug. 10, 1999.—An electrostatographic imaging member including an anti-curl layer, a supporting substrate having an electrically conductive layer, at least one imaging layer, an optional ground strip layer and an optional overcoating layer, the anti-curl layer including a film forming polymer binder selected from the group consisting of a polymer represented by the following structural formula:

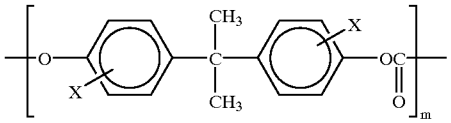

wherein m is an integer between about 100 and about 800 and X is selected from the group consisting of a halogen atom, a linear substituted or unsubstituted alkyl group containing 1 to 6 carbon atoms, and a substituted or unsubstituted cyclohexyl ring, and a polymer represented by the following structural formula:

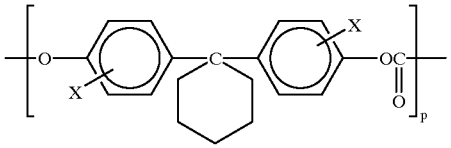

wherein p is an integer between about 100 and about 800 and X is selected from the group consisting of a halogen atom, a linear substituted or unsubstituted alkyl group containing 1 to 6 carbon atoms, and a substituted or unsubstituted cyclohexyl ring, and blends of these polymers, a copolyester adhesion promoter and dispersed particles selected from the group consisting of inorganic particles, organic particles and mixtures.

Thus, the characteristics of electrostatographic imaging members comprising a supporting substrate, having a conductive surface on one side, coated with at least one photoconductive layer and coated on the other side with an anti-curl layer exhibit deficiencies which are undesirable in automatic, cyclic electrostatographic copiers, duplicators, and printers.

SUMMARY OF THE INVENTION

It is an object of the invention to provide an electrostatographic imaging member which overcomes the above-noted disadvantages.

It is still another object of this invention to provide an electrostatographic imaging member which resists delamination between an anti-curl backing layer and the adjacent supporting substrate.

It is yet another object of this invention to provide an electrostatographic imaging member having an anti-curl layer with improved adhesion to a supporting substrate.

It is a further object of this invention to provide an electrostatographic imaging member with a wear resisting anti-curl layer.

It is also another object of this invention to provide an electrostatographic imaging member which produces less dust during cycling over stationary support members.

It is yet another object of the present invention to provide an improved layered flexible electrostatographic imaging web having reduced surface contact friction between the charge transport layer and the anti-curl layer in rolled up webstock.

It is still another object of the present invention to provide an improved layered flexible electrostatographic imaging belt which eliminates an audible humming noise during image cycling.

These and other objects of the present invention are accomplished by providing an electrostatographic imaging member comprising a supporting substrate layer, an anticurl backing layer on one side of the supporting layer and at least one imaging layer on the side of support member opposite the anticurl layer, the anti-curl layer comprising a polycarbonate film forming polymer binder containing the monomeric unit derived from 1,1-bis(4-hydroxyphenyl)-3,3,5-trimethylcyclohexane represented by Formula I below:

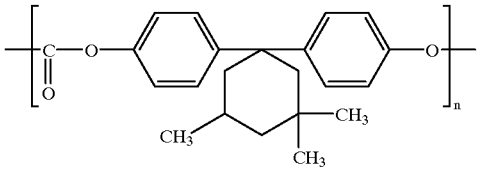

wherein:

n is 100 mole percent when the film forming polymer is a homopolymer and between about 10 mole percent and about 90 mole percent when the film forming polymer is a copolymer.

Preferably, the electrostatographic imaging member is an electrophotographic imaging member having a hole blocking layer on the conductive layer, an optional adhesive layer on the blocking layer and an imaging layer on either the conductive layer or on the optional adhesive layer, the imaging layer comprising a charge generating layer and a charge transport layer. The electrostatographic imaging member is preferably in the shape of a flexible belt which may be utilized in an electrographic or electrophotographic imaging process.

Although the present invention is deemed to encompass both electroreceptor and electrophotographic imaging members, for the purpose of illustration only, the discussion hereinafter will focus primarily on electrophotographic imaging members.

Electrostatographic imaging members are well known in the art. Electrostatographic imaging members may be prepared by various suitable techniques. Typically, a flexible substrate is provided having an electrically conductive surface. A charge generating layer is then applied to the electrically conductive surface. An optional charge blocking layer may be applied to the electrically conductive surface prior to the application of either a charge generating layer of a multiactive layer combination (charge generator layer and charge transport layer) or a single active photoconductive layer. If desired, an optional adhesive layer may be utilized between the charge blocking layer and the charge generating layer or single active photoconductive layer.

The substrate may be opaque or substantially transparent and may comprise numerous suitable materials having the required mechanical properties. Accordingly, the substrate may comprise a flexible layer of an electrically non-conductive or conductive material such as an inorganic or an organic composition. As electrically non-conducting materials there may be employed various resins known for this purpose including polyesters, polycarbonates, polyamides, polyurethanes, and the like which are flexible as thin webs. The electrically insulating or conductive substrate may be in the form of an endless flexible belt, a web, a sheet and the like.

The thickness of the substrate layer depends on numerous factors, including strength desired and economical considerations. Thus, this layer for a flexible belt may be of substantial thickness, for example, about 125 micrometers, or of minimum thickness less than 50 micrometers, provided there are no adverse effects on the final electrostatographic device. The surface of the substrate layer is preferably cleaned prior to coating to promote greater adhesion of the deposited coating. Cleaning may be effected, for example, by exposing the surface of the substrate layer to plasma discharge, ion bombardment and the like.

If the substrate is electrically conductive, it need not be coated with an electrically conductive coating. If the substrate is electrically insulating, it is usually coated with an electrically conductive layer. The electrically conductive layer may vary in thickness over substantially wide ranges depending on the optical transparency and degree of flexibility desired for the electrostatographic member. Accordingly, for a flexible photoresponsive imaging device, the thickness of the conductive layer may be between about 20 angstrom units to about 750 angstrom units, and more preferably from about 100 Angstrom units to about 200 angstrom units for an optimum combination of electrical conductivity, flexibility and light transmission. The flexible conductive layer may be an electrically conductive metal layer formed, for example, on the substrate by any suitable coating technique, such as a vacuum depositing technique. Typical metals include aluminum, zirconium, niobium, tantalum, vanadium and hafnium, titanium, nickel, stainless steel, chromium, tungsten, molybdenum, and the like. In general, a continuous metal film can be attained on a suitable substrate, e.g. a polyester web substrate such as Mylar available from E. I. du Pont de Nemours & Co. with magnetron sputtering.

If desired, an alloy of suitable metals may be deposited. Typical metal alloys may contain two or more metals such as zirconium, niobium, tantalum, vanadium and hafnium, titanium, nickel, stainless steel, chromium, tungsten, molybdenum, and the like, and mixtures thereof. A typical electrical conductivity for conductive layers for electrophotographic imaging members in slow speed copiers is about 102 to 103 ohms/square.

After formation of an electrically conductive surface, an optional hole blocking layer may be applied thereto for photoreceptors. Generally, electron blocking layers for positively charged photoreceptors allow holes from the imaging surface of the photoreceptor to migrate toward the conductive layer. Any suitable blocking layer capable of forming an electronic barrier to holes between the adjacent photoconductive layer and the underlying conductive layer may be utilized. The blocking layer may be nitrogen containing siloxanes or nitrogen containing titanium compounds such as trimethoxysilylpropylenediamine, hydrolyzed trimethoxysilylpropylethylenediamine, N-beta-(aminoethyl) gamma-amino-propyltrimethoxysilane, isopropyl4-aminobenzenesulfonyl, di(dodecylbenzenesulfonyl)titanate, isopropyldi(4-aminobenzoyl)isostearoyltitanate, isopropyltri(N-ethylamino-ethylamino)titanate, isopropyltrianthraniltitanate, isopropyltri(N,N-dimethylethylamino)titanate, titanium-4-aminobenzenesulfonatoxyacetate, titanium4-aminobenzoateisostearateoxyacetate, $[H_2N(CH_2)_4]CH_3Si(OCH_3)_2$, (gamma-aminobutyl)methyldiethoxysilane, and $[H_2N(CH_2)_3]CH_3Si(OCH_3)_2$(gamma-aminopropyl) methyldiethoxysilane, as disclosed in U.S. Pat. Nos. 4,338,387, 4,286,033 and 4,291,110. The disclosures of these three patents are incorporated herein in their entirety. A preferred blocking layer comprises a reaction product between a hydrolyzed silane and the oxidized surface of a metal ground plane layer. The blocking layer may be applied by any suitable conventional technique such as spraying, dip coating, draw bar coating, gravure coating, silk screening, air knife coating, reverse roll coating, vacuum deposition, chemical treatment and the like. The blocking layer should be continuous and have a thickness of between about 0.2 micrometer and about 5 micrometers.

An optional adhesive layer may applied to the hole blocking layer. Any suitable adhesive layer well known in the art may be utilized. Typical adhesive layer materials include, for example, polyesters, duPont 49,000 (available from E. I. duPont de Nemours and Company), Vitel PE100 (available from Goodyear Tire & Rubber), polyurethanes, and the like. Satisfactory results may be achieved with adhesive layer thickness between about 0.05 micrometer (500 angstroms) and about 0.3 micrometer (3,000 angstroms). Any suitable and conventional technique may be utilized to mix and thereafter apply the adhesive layer coating to the charge blocking layer. Conventional techniques for applying an adhesive layer coating mixture to the charge blocking layer include spraying, dip coating, roll coating, wire wound rod coating, gravure coating, Bird applicator coating, and the like. Drying of the deposited coating may be effected by any suitable conventional technique such as oven drying, infra red radiation drying, air drying and the like.

Any suitable photogenerating layer may be applied to the optional adhesive blocking layer. The photogenerating layer can then be overcoated with a contiguous hole transport layer as described hereinafter. Examples of typical photogenerating layers include organic photoconductive particles such as the X-form of metal free phthalocyanine described in U.S. Pat. No. 3,357,989, vanadyl phthalocyanine, copper phthalocyanine, titanyl phthalocyanine, hydroxy gallium phthalocyanine, dibromoanthanthrone, squarylium, quinacridones available from DuPont under the tradename Monastral Red, Monastral violet and Monastral Red Y, Vat orange 1 and Vat orange 3 trade names for dibromo anthanthrone pigments, benzimidazole perylene, substituted 2,4-diaminotriazines disclosed in U.S. Pat. No. 3,442,781, polynuclear aromatic quinones available from Allied Chemical Corporation under the tradename Indofast Double Scarlet, Indofast Violet Lake B, Indofast Brilliant Scarlet and Indofast Orange, and the like dispersed in a film forming polymeric binder. Other suitable photogenerating materials known in the art may also be utilized, if desired. Charge generating binder layers may comprise particles of a photoconductive material such as vanadyl phthalocyanine, metal free phthalocyanine, benzimidazole perylene, amorphous selenium, trigonal selenium, selenium alloys such as selenium-tellurium, selenium-tellurium-arsenic, selenium arsenide, and the like and mixtures. The charge generating layer of the photoreceptor of this invention preferably comprises a perylene pigment. The perylene pigment is preferably benzimidazole perylene which is also referred to as bis(benzimidazole). This pigment exists in the cis and trans forms. The cis form is also called bis-benzimidazo(2,1-a-1',1'-b)anthra(2,1,9-def:6,5,10-d'e'f')disoquinoline-6,11-dione. The trans form is also called bisbenzimidazo(2,1-a1',1'-b) anthra(2,1,9-def:6,5,10-d'e'f')disoquinoline-10,21-dione. Benzimidazoleperylene is ground into fine particles having an average particle size of less than about 1 micrometer and dispersed in a suitable film forming binder. Optimum results are achieved with a pigment particle size between about 0.1 micrometer and about 0.3 micrometer. Benzimidazole perylene is described in U.S. Pat. No. 5,019,473 and U.S. Pat. No. 4,587,189, the entire disclosures thereof being incorporated herein by reference.

The dispersions for charge generating layer may be formed by any suitable technique using, for example, attritors, ball mills, Dynomills, paintshakers, homogenizers, microfluidizers, and the like.

Any suitable polymeric film forming binder material may be employed as the matrix in the photogenerating binder layer. Typical polymeric film forming materials include those described, for example, in U.S. Pat. No. 3,121,006, the entire disclosure of which is incorporated herein by reference. Thus, typical organic polymeric film forming binders include thermoplastic and thermosetting resins such as polycarbonates, polyesters, polyamides, polyurethanes, polystyrenes, polyarylethers, polyarylsulfones, polybutadienes, polysulfones, polyethersulfones, polyethylenes, polypropylenes, polyimides, polymethylpentenes, polyphenylene sulfides, polyvinyl acetate, polysiloxanes, polyacrylates, polyvinyl acetals, polyamides, polyimides, amino resins, phenylene oxide resins, terephthalic acid resins, phenoxy resins, epoxy resins, phenolic resins, polystyrene and acrylonitrile copolymers, polyvinylchloride, vinylchloride and vinyl acetate copolymers, acrylate copolymers, alkyd resins, cellulosic film formers, poly(amideimide), styrene-butadiene copolymers, vinylidenechloride-vinylchloride copolymers, vinylacetate-vinylidenechloride copolymers, styrene-alkyd resins, polyvinylcarbazole, and the like. These polymers may be block, random or alternating copolymers.

The photogenerating composition or pigment is present in the resinous binder composition in various amounts, generally, however, from about 5 percent by volume to about 90 percent by volume of the photogenerating pigment is dispersed in about 10 percent by volume to about 95 percent by volume of the resinous binder, and preferably from about 20 percent by volume to about 30 percent by volume of the photogenerating pigment is dispersed in about 70 percent by volume to about 80 percent by volume of the resinous binder composition. In one embodiment about 8 percent by volume of the photogenerating pigment is dispersed in about 92 percent by volume of the resinous binder composition.

Any suitable solvent may be utilized to dissolve the binder. Typical solvents include tetrahydrofuran, toluene, methylene chloride, cyclohexanone, alkyl acetate and the like.

The photogenerating layer containing photoconductive pigment particles and the resinous binder material generally ranges in thickness of from about 0.1 micrometer to about 5 micrometers, and preferably has a thickness of from about 0.3 micrometer to about 3 micrometers. The photogenerating layer thickness is related to binder content. Higher binder content compositions generally require thicker layers for photogeneration. Thicknesses outside these ranges can be selected providing the objectives of the present invention are achieved.

Any suitable and conventional technique may be utilized to mix and thereafter apply the photogenerating layer coating mixture. Typical application techniques include spraying, dip coating, roll coating, wire wound rod coating, and the like.

Drying of the deposited coating may be effected by any suitable conventional technique such as oven drying, infra red radiation drying, air drying and the like. Drying is determined to be sufficient when the deposited film is no longer wet (not tacky to the touch).

The active charge transport layer may comprise any suitable transparent organic polymer or non-polymeric material capable of supporting the injection of photogenerated holes and electrons from the charge generation layer and allowing the transport of these holes or electrons through the transport layer to selectively discharge the surface charge. The active charge transport layer not only serves to transport holes or electrons, but also protects the charge generation (photoconductive) layer from abrasion or chemical attack and therefor extends the operating life of the photoreceptor imaging member. The charge transport layer in conjunction with the generation layer is a material which is an insulator to the extent that an electrostatic charge placed on the transport layer is not conducted in the absence of activating illumination. Thus, the active charge transport layer is a substantially non-photoconductive material which supports the injection of electron or photogenerated holes from the generation layer. The active transport layer is normally transparent when exposure is effected through the active layer to ensure that most of the incident radiation is utilized by the underlying charge carrier generator layer for efficient photogeneration.

Any suitable charge transporting or electrically active small molecule may be employed in the charge transport layer of this invention. Typical charge transporting small molecules include, for example, pyrazolines such as 1-phenyl-3(4'-diethylaminostyryl)-5-(4"-diethylaminophenyl)pyrazoline, diamines such as N,N'-diphenyl-N,N'-bis(3-methylphenyl)-(1,1'-biphenyl)-4,4'-diamine, hydrazones such as N-phenyl-N-methyl-3-(9-ethyl)carbazylhydrazone and 4,diethylaminobenzaldehyde-1,2diphenylhydrazone and oxadiazoles such as 2,5-bis(4-N,N'diethylaminophenyl)-1,2,4-oxadiazole, triphenyl methanes such as Bis(4,N,N-diethylamino-2-methylphenyl)-phenylmethane, stilbenes and the like. These electrically active small molecule charge transporting compounds should dissolve or molecularly disperse in electrically active charge transporting polymeric materials. The expression "charge transporting small molecule" as employed herein are defined as a monomeric chemical molecular species capable of supporting charge transport when dispersed in an electrically inactive organic resinous binder matrix. The expression "electrically active" when used to define the charge transport layer, the electrically active small molecule charge transporting compounds and the electrically active charge transporting polymeric materials means that the material is capable of supporting the injection of photogenerated holes from the generating material and capable of allowing the transport of these holes through the active transport layer in order to discharge a surface charge on the active layer. The expression "electrically inactive", when used to describe the electrically inactive organic resinous binder material which does not contain any electrically active moiety, means that the binder material is not capable of supporting the injection of photogenerated holes from the generating material and is not capable of allowing the transport of these holes through the material.

Still other examples of electrically active small molecule charge transporting compounds include aromatic amine compounds capable of supporting the injection of photogenerated holes and transporting the holes through the overcoating layer such as N,N'-diphenyl-N,N'-bis(alkylphenyl)-(1,1'-biphenyl)-4,4'-diamine wherein the alkyl is, for example, methyl, ethyl, propyl, n-butyl, and the like, N,N'-diphenyl-N,N'-bis(chlorophenyl)-[1,1'-biphenyl]-4,4'-diamine, N,N'-diphenyl-N,N'-bis(3-methylphenyl)-(1,1'-biphenyl)-4,4'-diamine, and the like. The specific aromatic diamine charge transport layer compound illustrated in the formula above is described in U.S. Pat. No. 4,265,990, the entire disclosure thereof being incorporated herein by reference.

Other examples of aromatic diamine small molecule charge transport layer compounds include, for example, N,N,N',N'-tetraphenyl-[3,3'-dimethyl-1,1'-biphenyl]-4,4'-diamine; N,N'-diphenyl-N,N'-bis(2-methylphenyl)-[3,3'dimethyl-1,1'-biphenyl]-4,4'-diamine; N,N'-diphenyl-N,N'-bis(3-methylphenyl)-[3,3'-dimethyl-1,1'-biphenyl]-4,4'-diamine; N,N'-diphenyl-N,N'-bis(4-methylphenyl)-[3,3'dimethyl-1,1'-biphenyl]-4,4'-diamine; N,N,N',N'-tetra(2-methylphenyl)-[3,3'-dimethyl-1,1'-biphenyl]-4,4'-diamine; N,N'-bis(2-methylphenyl)-N,N'-bis(4-methylphenyl)-[3,3'-dimethyl-1,1'-biphenyl]-4,4'-diamine; N,N'-bis(3-methylphenyl)-N,N'-bis(2-methylphenyl)-[3,3'-dimethyl-1,1'-biphenyl]-4,4'-diamine; N,N,N',N'-tetra(3-methylphenyl)-[3,3'-dimethyl-1,1'-biphenyl]-4,4'-diamine; N,N'-bis(3-methylphenyl)-N,N'-bis(4-methylphenyl)-[3,3'-dimethyl-1,1'-biphenyl]-4,4'-diamine; and N,N,N',N'-tetra(4-methylphenyl)-[3,3'-dimethyl-1,1'-biphenyl]-4,4'-diamine. The aromatic diamine small molecule charge transport layer compounds illustrated in the formula above are described in U.S. Pat. No. 4,299,897, the entire disclosure thereof being incorporated herein by reference. Additional examples of small molecule charge transporting compounds include, for example, N,N,N',N'-Tetra-(4-methylphenyl)-[3,3'-dimethyl-1,1'-biphenyl]-4,4'-diamine' N,N'-diphenyl-N,N'-bis(4-methylphenyl)-[3,3'-dimethyl-1,1'-biphenyl]-4,4'-diamine, and N,N'-bis(4-methylphenyl)-N,N'-bis(4-ethylphenyl)-[3,3'-dimethyl-1,1'-biphenyl]-4,4'-diamine. The substituents of aromatic diamine molecules should be free from electron withdrawing groups such as $NO_2$ groups, CN groups, and the like.

An especially preferred transport layer employed in one of the two electrically operative layers in the multilayer photoconductor of this invention comprises from about 25 to about 75 percent by weight of at least one charge transporting aromatic amine compound, and about 75 to about 25 percent by weight of a polymeric film forming resin in which the aromatic amine is soluble. A dried charge transport layer containing between about 40 percent and about 50 percent by weight of the small molecule charge transport molecule based on the total weight of the dried charge transport layer is preferred.

Any suitable and conventional technique may be utilized to mix and thereafter apply the charge transport layer coating mixture to the charge generating layer. Typical application techniques include spraying, dip coating, roll coating, wire wound rod coating, and the like. Drying of the deposited coating may be effected by any suitable conventional technique such as oven drying, infra red radiation drying, air drying and the like.

The hole transport layer preferably contains between about 25 to about 75 percent by weight of the small molecule hole transport compound, based on the total weight of the transport layer after drying.

Any suitable inactive resin binder soluble in chlorinated solvent or other suitable solvent may be employed in the process of this invention. Typical inactive resin binders soluble in these solvents include polycarbonate resin, polyvinylcarbazole, polyester, polyarylate, polyacrylate, polyether, polysulfone, and the like. Weight average molecular weights can vary from about 20,000 to about 1,500,000. The preferred electrically inactive resin materials are polycarbonate resins have a molecular weight from about 20,000 to about 120,000, more preferably from about 50,000 to about 100,000. Examples of the electrically inactive resin material include poly(4,4'-dipropylidene-diphenylene carbonate) with a molecular weight of from about 35,000 to about 40,000, available as Lexan 145 from General Electric Company; poly(4,4'-isopropylidene-diphenylene carbonate) with a molecular weight of from about 40,000 to about 45,000, available as Lexan 141 from the General Electric Company; a polycarbonate resin having a molecular weight of from about 50,000 to about 100,000, available as Makrolon from Farbenfabricken Bayer A.G., a polycarbonate resin having a molecular weight of from about 20,000 to about 50,000 available as Merlon from Mobay Chemical Company, and a polycarbonate resin available as PCZ 400 from Mitsubishi Chemical Co.

Any suitable solvent may be utilized to dissolve the polycarbonate film forming binder in the charge transport layer coating composition. Chlorinated solvents are an especially desirable component of the charge transport layer coating mixture for adequate dissolving of all the components in the charge transport layer.

Any suitable and conventional technique may be utilized to mix and thereafter apply the charge transport layer coating mixture to the charge generating layer. Typical application techniques include spraying, dip coating, roll coating, wire wound rod coating, and the like. Drying of the deposited coating may be effected by any suitable conventional technique such as oven drying, infra red radiation drying, air drying and the like. Generally, the thickness of the transport layer is between about 5 micrometers to about 100 micrometers, but thicknesses outside this range can also be used, provided there are no adverse effects on the final electrophotographic imaging device. The hole transport layer should be an insulator to the extent that the electrostatic charge placed on the hole transport layer is not conducted in the absence of illumination at a rate sufficient to prevent formation and retention of an electrostatic latent image thereon. In general, the ratio of the thickness of the hole transport layer to the charge generator layer is preferably maintained from about 2:1 to 200:1 and in some instances as great as 400:1. In other words, the charge transport layer, is substantially non-absorbing to visible light or radiation in the region of intended use but is "active" in that it allows the injection of photogenerated holes from the photoconductive layer, i.e., charge generation layer, and allows these holes to be transported through the active charge transport layer to selectively discharge a surface charge on the surface of the active layer.

Examples of electrophotographic imaging members having at least two electrically operative layers, including a charge generator layer and diamine containing transport layer, are disclosed in U.S. Pat. No. 4,265,990, U.S. Pat. No. 4,233,384, U.S. Pat. No. 4,306,008, U.S. Pat. No. 4,299,897 and U.S. Pat. No. 4,439,507, the disclosures thereof being incorporated herein in their entirety.

Other layers may also be used such as conventional electrically conductive ground strip along one edge of the belt or drum in contact with the conductive layer, blocking layer, adhesive layer or charge generating layer to facilitate connection of the electrically conductive layer of the photoreceptor to ground or to an electrical bias. Ground strips are well known and usually comprise conductive particles dispersed in a film forming binder. Optionally, an overcoat layer may also be utilized to improve resistance to abrasion. An optional bar code may be printed on the underside of the substrate for the purpose of identifying individual photoreceptors. Any suitable bar code ink may be used, for example WT1006 Printing Ink from Domino/Amjet, Inc.

The anti-curl layer of the present invention comprises a polycarbonate film forming polymer binder derived from the monomeric unit 1,1-bis(4-hydroxyphenyl)-3,3,5-trimethylcyclohexane represented by Formula I below:

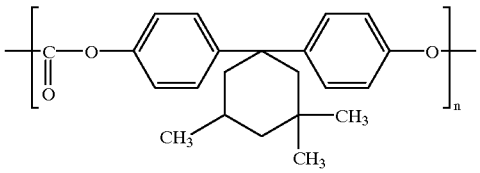

wherein:

n is 100 mole percent when the film forming polymer is a homopolymer and between about 10 mole percent and about 90 mole percent when the film forming polymer is a copolymer.

Whether this film forming polymer is a homopolymer or a copolymer, the polymer always contains units having the structure represented by Formula I above. Thus, the polycarbonate film forming polymer binder in the anti-curl layer of the present invention contains 3,3,5-trimethylcyclohexane groups in the polycarbonate moiety.

More specifically, the anti-curl layer of the present invention may comprise a film forming polymer binder represented by the structure represented by Formula II below:

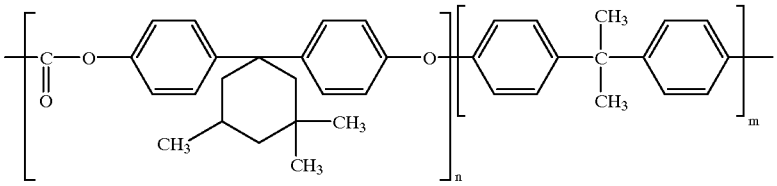

wherein:

n is between 10 and 100 mole percent and m is between 90 and 0 mole percent.

The process for synthesizing these film forming polymers are known and described, for example, in U.S. Pat. No. 5,227,458, the entire disclosure thereof being incorporated herein by reference. Preferably, the polycarbonate film forming polymer utilized in the anticurl backing of this invention has a weight average molecular weight between about 20,000 and about 300,000 and a glass transition temperature of between about 150° C. and about 300° C. These polycarbonate film forming materials are commercially available as, for example homopolymer APEC 9204, available from Bayer A.G. and having a weight average molecular weight of about 300,000 and a glass transition temperature of about 245° C.; copolymer APEC 9203, available from Bayer A.G. where n=56 mole percent; copolymer APEC 9202, available from Bayer A.G. where n=36 mole percent; and APEC 9201, available from Bayer A.G. where n=10 mole percent. When the polycarbonate film forming polymer binder containing a trimethylcyclohexane group in the polycarbonate moiety is a copolymer, the copolymer should comprise at least about 10 mole percent of the moiety represented by the above illustrated Formula I. If desired, homopolymers or copolymers made up of monomeric units illustrated by the above formulae may be blended with other different miscible film forming polymers. Typical miscible film forming polymers include for example polycarbonate A [poly(4,4'-isopropylidene-diphenylene)carbonate], polycarbonate C [2,2-bis(4-hydroxy-3-methylphenyl)propane], polycarbonate Z [poly(4,4'-diphenyl-1,1'-cyclohexane)carbonate], copolyesters, and the like. Generally, the blend of polymers should contain at least about 40 percent by weight of a homopolymer made up of monomeric units represented by Formula I depicted above, based on the total weight of the blend. Blends of polymers should contain at least 50 percent by weight of a copolymer represented by Formula II depicted above, based on the total weight of the blend. The blend should be homogeneous and substantially free of phase separation. The miscibility of polymers varies from small percentages up to 100 percent. For example, Apec HT 9204 and polycarbonate A (Makrolon, available from Bayer AG) are miscible up to about 100 percent by weight based on the total weight of the blend. Phase separation can occur at percentages greater than about ten percent by weight of polycarbonate A (Makrolon, available from Bayer AG) and copolyester (PE100, available from Goodyear Tire and Rubber). Any suitable anticurl layer thickness may be utilized. A typical thickness range is about between 2 micrometers and about 20 micrometers. Preferably, the thickness of the anticurl layer is between about 10 micrometers and about 16 micrometers. The thickness should be sufficient to flatten the photoreceptor belt after drying.

The anti-curl backing layer of this invention exhibits superior adhesion to the substrate layer. When the anticurl layer contains polycarbonate homopolymer APEC HT, available from Bayer AG, adhesion between the anticurl layer and the adjacent flexible polyethylene terephthalate substrate layer is increased 2 to 4 times over the adhesion observed between polycarbonate A (Makrolon, available from Bayer AG) and the adjacent flexible polyethylene terephthalate substrate. Moreover, the anticurl backing layer containing the polycarbonate of this invention exhibits greater wear resistance during image cycling compared to anticurl backing layer containing polycarbonate A.

Any suitable solvent may be utilized to dissolve the film forming polymers for solvent coating. The anti-curl backing layer of this invention is soluble in a variety of solvents including methylene chloride, chloroethane, chlorobenzene and nonhalogenated solvents such as toluene, tetrahydrofuran, pyridine, phenol, and the like thereby allowing avoidance of methylene chloride.

The anti-curl layer of this invention may also contain additives for adhesion such as a copolyester. Any suitable copolyester may be utilized in the anti-curl layer of this invention. Typical copolyesters include those described in U.S. Pat. No. 5,021,309, the entire disclosure thereof being incorporated herein by reference. A specific example of a copolyester is Vitel PE-100 is available from Goodyear Tire and Rubber Company. This polyester resin is a linear saturated copolyester of two diacids and ethylene glycol. The ratio of diacid to ethylene glycol in the copolyester is 1:1. The diacids are terephthalic acid and isophthalic acid. The ratio of terephthalic acid to isophthalic acid is 3:2. The Vitel PE-100 linear saturated copolyester consists of alternating monomer units of ethylene glycol and two randomly sequenced diacids in the above indicated ratio and has a molecular weight of about 50,000 and a Tg of about 71° C. Another polyester resin adhesive is Vitel PE-200 available from Goodyear Tire & Rubber Co. This polyester resin is a linear saturated copolyester of two diacids and two diols. The ratio of diacid to ethylene glycol in this copolyester is 1:1. The diacids are terephthalic acid and isophthalic acid. The ratio of terephthalic acid to isophthalic acid is 1.2:1. The two diols are ethylene glycol and 2,2-dimethyl propane diol. The ratio of ethylene glycol to dimethyl propane diol is 1.33:1. Goodyear Vitel PE-200 linear saturated copolyester consists of randomly alternating monomer units of the two diacids and the two diols in the above indicated ratio and has a molecular weight of about 45,000 and a Tg of about 67° C. Other copolyesters such as 49000, available from Morton Chemical may also be used. Preferably, the anti-curl layer of this invention comprises between about 0.5 percent by weight and about 10 percent by weight of the copolyester adhesion promoter, based on the total weight of the anti-curl layer after drying.

If desired, other additives may also be present in the anticurl backing layer. These additives can include, for example, organic particles, inorganic particles or mixtures thereof dispersed in the continuous matrix of the anticurl backing layer. The organic materials have lubricating properties that promote a sliding action between two contacting surfaces thereby reducing frictional force and improving wear resistance of the anti-curl layer. Typical organic particles having lubricating properties include, for example, polytetrafluoroethylene, waxy polyethylene, metal stearates, fatty amides, and the like. The inorganic particles having a hardness of at least 4.0 mohs are hard and have inherent wear resisting properties. Typical hard inorganic particles having wear resisting properties include, for example, micro-crystalline silica, amorphous silica, mineral particles, and the like. Preferably, the inorganic particles are surface treated with a coupling agent to promote better physical and chemical interactions between the dispersed inorganic particles and the matrix polymer binder. Any suitable coupling agent may by utilized. Typical coupling agents include, for example, dimethyl dichloro silane, hexamethyl disilazane, fluorosilane, titanate, zirconate, and the like. The surface of the inorganic particles are rendered hydrophobic by these coupling agents. Although not limited to these materials, two specific exemplary bifunctional silane coupling agents are especially preferred. These preferred coupling agents are chloropropyl triethoxy silane having the molecular formula $Cl(CH_2)_3—Si(OC_2H_5)_3$ and azido silane having the molecular formula $(CH_3CH_2O)_3—Si—R—SO_2N_3$. These organic and inorganic particles are described in U.S. Pat. No. 5,096,795, the entire disclosure thereof being incorporated herein by reference. Preferably, these particles are present in the anti-curl layer in an amount between about 0.5 percent by weight and 10 percent by weight, based on the total weight of the anti-curl layer after drying. Optimum results are obtained with particle dispersions of between about 1 percent by weight and about 5 percent by weight, based on the total weight of the anti-curl layer. The particles dispersed in the anti-curl layer should have a particle size substantially smaller than the coating layer thickness after drying. Typical average particle sizes are between about 0.1 micrometer and about 5 micrometers.

The electrophotographic imaging member embodiment of the present invention may be employed in any suitable and conventional electrophotographic imaging process which utilizes uniform charging prior to imagewise exposure to activating electromagnetic radiation. When the imaging surface of an electrophotographic member is uniformly charged with an electrostatic charge and imagewise exposed to activating electromagnetic radiation. Conventional positive or reversal development techniques may be employed to form a marking material image on the imaging surface of the electrophotographic imaging member of this invention. Thus, by applying a suitable electrical bias and selecting toner having the appropriate polarity of electrical charge, one may form a toner image in the charged areas or discharged areas on the imaging surface of the electrophotographic member of the present invention. For example, for positive development, charged toner particles are attracted to the oppositely charged electrostatic areas of the imaging surface and for reversal development, charged toner particles are attracted to the discharged areas of the imaging surface. The electrographic imaging member embodiment of this invention may be utilized in any suitable electrographic imaging system in which a shaped electrostatic image is directly formed on a dielectric imaging layer by any suitable means such as styli, shaped electrodes, ion streams, and the like.

The anti-curl layer of this invention exhibits enhanced wear resistance as well as improved adhesion with the substrate layer. The anti-curl layer of this invention also maintains the optical transmission requirement of the anti-curl layer in embodiments where light must be transmitted through the layer during electrophotographic imaging processes to ensure back erase.

PREFERRED EMBODIMENT OF THE INVENTION

The invention will further be illustrated in the following non-limiting examples, it being understood that these examples are intended to be illustrative only and that the invention is not intended to be limited to the materials, conditions, process parameters and the like recited herein.

CONTROL EXAMPLE I

An electrophotographic imaging member was prepared by providing a 0.02 micrometer thick titanium layer coated on a polyester substrate (Melinex 442, available from ICI Americas, Inc.) having a thickness of 3 mils (76.2 micrometers) and applying thereto, using a ½ mil gap Bird applicator, a solution containing 10 grams gamma aminopropyltriethoxy silane, 10.1 grams distilled water, 3 grams acetic acid, 684.8 grams of 200 proof denatured alcohol and 200 grams heptane. This layer was then allowed to dry for 5 minutes at 135° C. in a forced air oven. The resulting blocking layer had an average dry thickness of 0.05 micrometer measured with an ellipsometer.

A bar code was coated on the reverse side of the polyester substrate applying by ink jet process, WT1006 Printing Ink available from Domino/Amjet Inc. This bar code was cured by UV exposure.

An adhesive interface layer was then prepared by applying with a ½ mil gap Bird applicator to the blocking layer a wet coating containing 0.5 percent by weight based on the total weight of the solution of polyester adhesive (Mor-Ester 49,000, available from Morton International, Inc.) in a 70:30 volume ratio mixture of tetrahydrofuran/cyclohexanone. The adhesive interface layer was allowed to dry for 5 minutes at 135° C. in a forced air oven. The resulting adhesive interface layer had a dry thickness of 0.065 micrometer.

The adhesive interface layer was thereafter coated with a photogenerating layer containing 40 percent by volume benzimidazole perylene (BzP), and 60 percent by volume polycarbonate-Z (PC-Z). This photogenerating layer was prepared by introducing 0.45 grams polycarbonate-Z and 50 mls of tetrahydrofuran into a 4 oz. amber bottle. To this solution was added 2.4 grams of BzP and 300 grams of ⅛ inch (3.2 millimeter) diameter stainless steel shot. This mixture was then placed on a ball mill for 72 to 96 hours. Subsequently, 2.25 grams of polycarbonate-Z was dissolved in 46.1 gm of tetrahydrofuran, then added to this BzP slurry. This slurry was then placed on a shaker for 10 minutes. The resulting slurry was thereafter applied to the adhesive interface layer by using a ½ mil gap Bird applicator to form a coating layer having a wet thickness of 0.5 mil (12.7 micrometers). However, a strip about 10 mm wide along one edge of the substrate bearing the blocking layer and the adhesive layer was deliberately left uncoated by any of the photogenerating layer material to facilitate adequate electrical contact by the ground strip layer that was applied later. This photogenerating layer was dried at 135° C. for 5 minutes in a forced air oven to form a dry photogenerating layer having a thickness of 1.0 micrometers.

This coated imaging member web was simultaneously overcoated with a charge transport layer and a ground strip layer using a 3 mil gap Bird applicator. The charge transport layer was prepared by introducing into an amber glass bottle a weight ratio of 1:1 N,N'-diphenyl-N,N'-bis(3-methylphenyl)-1,1'-biphenyl-4-4'-diamine and Makrolon 5705, a polycarbonate resin having a molecular weight of from about 50,000 to 100,000 commercially available from Farbenfabriken Bayer A.G. The resulting mixture was dissolved to give a 15 percent by weight solid in 85 percent by weight methylene chloride. This solution was applied onto the photogenerator layer to form a coating which upon drying had a thickness of 24 micrometers.

The approximately 10 mm wide strip of the adhesive layer left uncoated by the photogenerator layer was coated with a ground strip layer. This ground strip layer, after drying at 135° C. in a forced air oven for 5 minutes, had a dried thickness of about 14 micrometers. This ground strip is electrically grounded, by conventional means such as a carbon brush contact device during a conventional xerographic imaging process.

An anti-curl coating was prepared by combining 8.28 gm by weight of polycarbonate resin of 4,4'-isopropylidene diphenol having a weight average molecular weight of about 120,000 and a Tg of 150° C. (Makrolon 5705, available from Bayer AG), 0.72 grams of copolyester resin (Vitel PE-200, available from Goodyear Tire and Rubber Company) and 91 grams of methylene chloride in a glass container to form a coating solution containing 9 percent solids. The container was covered tightly and placed on a roll mill for about 24 hours until the polycarbonate and polyester were dissolved in the methylene chloride to form the anti-curl coating solution. The anti-curl coating solution was then applied to the rear surface (side opposite the photogenerator layer and charge transport layer) of the imaging member with a 4 mil gap Bird applicator and dried at 135° C. for about 5 minutes in a forced air oven to produce a dried film thickness of about 13.5 micrometers and containing approximately 8 weight percent Vital PE-200, adhesion promoter, based on the total weight of the dried anti-curl layer. The resulting electrophotographic imaging member served as a control imaging member. Makrolon 5705 is polycarbonate A which can be represented by the following structural formula:

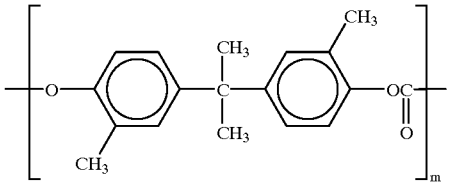

EXAMPLE II

An electrophotographic imaging member of this invention was prepared by following the procedures and using the same materials as described in the Control Example I, except that the polycarbonate resin of the anti-curl layer was substituted with a polycarbonate containing a trimethylcyclohexane group (APEC HT grade KU 1-9204, available from Bayer AG) and having the formula:

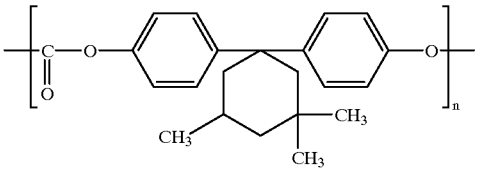

This polycarbonate had a weight average molecular weight of about 300,000 and a Tg of 245° C. The resulting anti-curl layer of this invention was optically clear like that of the control.

COMPARATIVE EXAMPLE III

An electrophotographic imaging member was prepared by following the procedures and using the same materials as described in the Control Example I, except that the polycarbonate resin of the anti-curl layer was substituted with a polycarbonate Z (Available as UPILON-Z-800 from Mitsubishi Gas Chemical Inc) and having the formula:

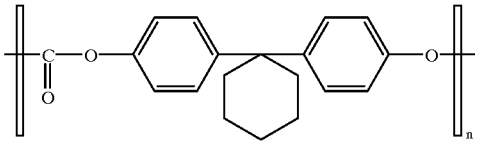

This polycarbonate had a weight average molecular weight of about 80,000 and a Tg of 175° C. The resulting anti-curl layer of this invention was optically clear like that of the control.

EXAMPLE IV

The adhesive strength of the anti-curl layers of Examples I and II were tested with an Instron peel tester. The results are shown in Table A below:

TABLE A

| ANTICURL LAYER POLYMER | AVG. PEEL STRENGTH g/cm |
|---|---|
| Makrolon | 112.5 (n = 6) |
| APEC HT | 205 (n = 5) |
| PC-Z | 8.4 (n = 3) |

These tests illustrate that adhesion of the anti-curl layer of this invention is 282 percent greater than a common anticurl layer of the prior art.

The peel strength was assessed by cutting a minimum of three 0.5 inch (1.2 cm.)×6 inches (15.24 cm.) imaging member samples from each of Examples I, II and III. For each sample, the anti-curl layer was partially stripped from the test sample with the aid of a razor blade and then hand peeled to about 3.5 inches from one end to expose the substrate support layer inside the sample. This stripped sample was then secured to a 1 inch (2.54 cm.)×6 inches (15.24 cm.) and 0.05 inch (0.254 cm.) thick aluminum backing plate (having the charge transport layer facing the backing plate) with the aid of two sided adhesive tape. The end of the resulting assembly, opposite the end from which the anti-curl layer was not stripped, was inserted into the upper jaw of an Instron Tensile Tester. The free end of the partially peeled anti-curl layer was inserted into the lower jaw of the Instron Tensile Tester. The jaws were then activated at a one inch/mm. crosshead speed, a two inch chart speed and a load range of 200 grams, to peel the sample at least two inches at an angle of 1800. The load was calculated to derive the peel strength of the sample. The peel strength was determined to be the load required for stripping the anti-curl layer divided by the width (1.27 cm.) of the test sample.

EXAMPLE V

The photoreceptor fabrication process of Example II was repeated except that the percent by weight of the adhesion promoter copolyester PE-200 was varied from 0 percent to 8 percent, based on the total dried weight. The adhesive strength of the anti-curl layers containing various amounts of PE-200 were tested with an Instron peel tester. The results are shown in Table B below:

TABLE B

| ANTICURL LAYER % PE-200 | PEEL STRENGTH g/cm |
|---|---|
| 0 | 65 |
| 2 | 212 |
| 5 | 226 |
| 8 | 281 |

These tests illustrate that even with less adhesion promoter in the anti-curl layer, the invention gives superior adhesion over the control Example I.

EXAMPLE VI

The photoreceptor fabrication process of Example II was repeated except that instead of the using only APEC HT as the only polycabonate component in the anti-curl layer, APEC HT was blended with Makrolon 5705 polycarbonate in various weight ratios ranging from 0 to 75. The adhesive strength of the anti-curl layers containing various amounts of APEC HT were tested with an Instron peel tester. The results are shown in Table C below:

TABLE C

| WEIGHT RATIO APEC/MAKROLON | PEEL STRENGTH g/cm |
|---|---|
| 100/0 | 281 |
| 75/25 | 245 |
| 50/50 | 158 |
| 25/75 | 103 |

These tests illustrate that the addition of the APEC HT can increase the adhesion of the current anti-curl layer formula.

EXAMPLE VII

The electrophotographic imaging members of Examples I, II were also cut to a size of 1 inch (2.54 cm.) by 12 inches (30.48 cm.) and each tested for resistance to wear of the anti-curl layers. Results are shown in Table D below. Testing was effected by means of a dynamic mechanical cycling device in which hard anodized aluminum tubes were skidded across the surface of the anti-curl layer on each imaging member with one pound per inch width tension on the sample. The aluminum cylinders were adjusted to provide the equivalent of 11.3 inches (28.7 cm.) per second tangential speed. The extent of anti-curl coating wear was measured using a permascope at the end of a 330,000 wear cycle test.

TABLE D

| ANTI-CURL POLYMER | LOSS OF THICKNESS |
|---|---|
| MAKROLON | 16.8% |
| APEC HT | 14.6% |

These tests illustrate that the APEC HT has more wear resistance as indicated by less loss of thickness than the current anticurl polymer.

EXAMPLE VIII

An electrophotographic imaging member was prepared by following the procedures and using the same materials as described in Example I and II, except that the anti-curl coating solution was then applied to the rear surface (side opposite the photogenerator layer and charge transport layer) of the imaging member and covering the bar code with a 4 mil gap Bird applicator and dried at 135° C. for about 5 minutes in a forced air oven to produce a dried film thickness of about 13.5 micrometers. The adhesive strength of the anti-curl layers coated over the bar code were tested with an Instron peel tester. The results are shown in Table E below:

TABLE E

| ANTI-CURL POLYMER | PEEL STRENGTH g/cm |
|---|---|
| MAKROLON | 32.6 |
| APEC HT 9204 | 119.3 |

This test indicates that the APEC HT polymer also exhibits 366 percent superior adhesion on the epoxide ultra violet cured resin which makes up the bar code.

Although the invention has been described with reference to specific preferred embodiments, it is not intended to be limited thereto, rather those skilled in the art will recognize that variations and modifications may be made therein which are within the spirit of the invention and within the scope of the claims.

What is claimed is:

1. An electrostatographic imaging member comprising a supporting substrate layer having an electrically conductive surface, an anticurl backing layer on one side of the supporting layer and at least one imaging layer on the side of support member opposite the anticurl layer, the anti-curl layer comprising a polycarbonate film forming polymer binder containing the monomeric unit derived from 1,1-bis (4-hydroxyphenyl)-3,3,5-trimethylcyclohexane represented by the following formula I

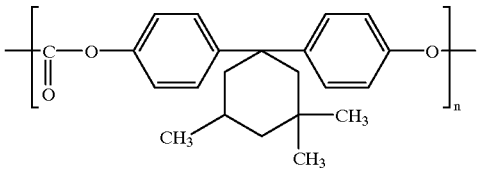

wherein:

n is 100 mole percent when the film forming polymer is a homopolymer and between about 10 mole percent and about 90 mole percent when the film forming polymer is a copolymer.

2. An electrostatographic imaging member according to claim 1 wherein the polycarbonate film forming polymer binder has a structure represented by the following formula:

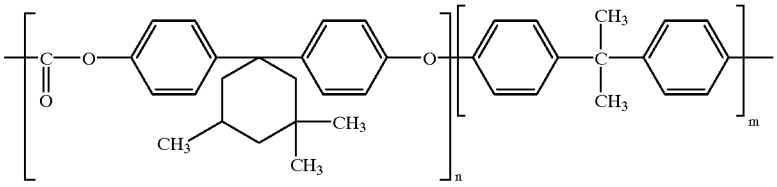

wherein:

n is between 10 and 100 mole percent and m is between 90 and 0 mole percent.

3. An electrostatographic imaging member according to claim 1 wherein at least one imaging layer comprises an electrophotographic imaging layer.

4. An electrostatographic imaging member according to claim 3 wherein the electrophotographic imaging layer comprises a charge generating layer and a charge transport layer.

5. An electrostatographic imaging member according to claim 1 wherein at least one imaging layer comprises a dielectric electrographic imaging layer.

6. An electrostatographic imaging member according to claim 1 wherein the polycarbonate film forming polymer binder is a homopolymer.

7. An electrostatographic imaging member according to claim 1 wherein the polycarbonate film forming polymer binder has a weight average molecular weight between about 20,000 and about 300,000.

8. An electrostatographic imaging member according to claim 1 wherein the wherein the polycarbonate film forming polymer binder is copolymer reaction product of 1,1-bis(4-hydroxyphenyl)-3,3,5-trimethylcyclohexane and bisphenol A.

9. An electrostatographic imaging member according to claim 1 wherein the anti-curl layer the polycarbonate film forming polymer binder contains 3,3,5-trimethylcyclohexane groups in the polycarbonate moiety and is blended with a different miscible film forming binder.

10. An electrostatographic imaging member according to claim 1 wherein the anti-curl layer also comprises an additive for adhesion comprising a copolyester of diacids and diols.

11. An electrostatographic imaging member according to claim 1 wherein the anti-curl layer has a thickness between about 2 micrometers and about 20 micrometers.

12. An electrostatographic imaging member comprising an anti-curl layer, a supporting substrate having an electrically conductive layer, at least one imaging layer, an optional ground strip layer and an optional overcoating layer, the anti-curl layer comprising a polycarbonate film forming polymer binder containing 3,3,5-trimethylcyclohexane groups in the polycarbonate moiety.

* * * * *